United States Patent [19]

ter Horst

[11] Patent Number: 4,804,174

[45] Date of Patent: Feb. 14, 1989

[54] APPARATUS FOR COLLECTING SHEETS OF DIFFERENT LENGTHS

[75] Inventor: Gerhardus E. R. ter Horst, Venlo, Netherlands

[73] Assignee: OCE-Nederland B.V., Venlo, Netherlands

[21] Appl. No.: 55,639

[22] Filed: May 28, 1987

[30] Foreign Application Priority Data

Jun. 5, 1986 [NL] Netherlands ..... 8601449

[51] Int. Cl.[4] ..... B65H 31/00

[52] U.S. Cl. ..... 271/207; 271/209; 271/175; 271/197; 271/204; 414/792.7

[58] Field of Search ..... 271/207, 307, 312, 209, 271/188, 223, 311, 175, 197, 145, 3.1, 204; 226/118, 119; 83/86; 414/97

[56] References Cited

U.S. PATENT DOCUMENTS

| | | | |
|---|---|---|---|
| 3,556,374 | 1/1971 | Demke | 226/119 |
| 3,807,726 | 4/1974 | Hope et al. | 271/207 |
| 4,083,556 | 4/1978 | Schilling et al. | 271/204 |
| 4,207,579 | 6/1980 | Gamblin et al. | 271/197 X |
| 4,362,452 | 12/1982 | Sparr | 271/3.1 X |
| 4,421,306 | 12/1983 | Muka | 271/3.1 X |
| 4,474,367 | 10/1984 | Jongerling et al. | 271/197 |
| 4,477,822 | 10/1984 | Luoma et al. | 226/118 X |

FOREIGN PATENT DOCUMENTS

| | | | |
|---|---|---|---|
| 58-68734 | 4/1983 | Japan . | |
| 60-36261 | 2/1985 | Japan | 271/207 |

OTHER PUBLICATIONS

I.B.M. Technical Disclosure Bulletin, vol. 18, No. 7, 12/75.

I.B.M. Technical Disclosure Bulletin, vol. 20, No. 6, 11/77.

*Primary Examiner*—Michael S. Huppert
*Assistant Examiner*—Gregory L. Huson
*Attorney, Agent, or Firm*—Reed Smith Shaw & McClay

[57] ABSTRACT

An apparatus for collecting sheets of different lengths in a tray having first and second parts and wherein the second part of the tray consists of a first portion which adjoins the first part and from there extends downwardly to receive the trailing part of sheets of intermediate lengths, and a second portion which adjoins the bottom point of the first portion and from there extends upwardly in order to receive the trailing part of sheets of longer lengths than the intermediate lengths.

8 Claims, 3 Drawing Sheets

APPARATUS FOR COLLECTING SHEETS OF DIFFERENT LENGTHS

FIELD OF THE INVENTION

The invention relates to an apparatus for processing sheets of different lengths and, in particular, to a collection means for copy sheets having a sheet collecting tray with a first collecting part and a conveyor system for feeding sheets into the first collection part.

BACKGROUND OF THE INVENTION

Exit trays and apparatus for collecting variously sized copy paper are generally well known. For example, see IBM Technical Disclosure bulletin Vol. 18, December 1975, pages 2059–60 and Vol. 20, No. 6, November 1977, pages 2122–24. These disclosures describe a sheet collecting system with a copier, comprising a sheet collecting tray formed by a base and an abutment ledge adjoining a side of the baseplate remote from the copier. Long copies are fed directly into the collecting tray by a first pair of conveyor rollers disposed a considerable distance in front of the abutment, and short copies, after passing the first pair of conveyor rollers, are deflected, by a sheet deflector which can be actuated selectively, to a second pair of conveyor rollers situated nearer the abutment. The second pair of conveyor rollers feed the short copies into the collecting tray.

This known apparatus is suitable for feeding sheets of different lengths to an abutment in a collecting tray. However, two pairs of conveyor rollers are required for this purpose, and a sheet deflector which has to be set to a specific position for processing short sheets in order to guide these short sheets via the second pair of rollers into the collecting tray. The result is a collecting system which is complex and occupies considerable space.

Another type of collection system is shown in Japanese Application No. JP-A 58-68734. In this application a tray having two parts and a conveyor system for feeding long and short sheets into the tray which conveyor system is located near an edge of the tray. However, because of the arrangement of the conveyor system, long and short sheets can not be delivered interchangeable, for example, a long sheet overlying both parts would interfere with a short sheet lying in just one of the parts.

It is, therefore, an object of the present invention to provide a sheet processing apparatus which has a simple sheet collecting system which is capable of collecting sheets of different lengths interchangeably.

SUMMARY OF THE INVENTION

Generally, the present invention comprises a collecting tray having an outermost first and intermost second collecting parts. The second collecting part is located at the level of the sheet feeding conveyor system where it adjoins the first collecting part. A guide means is provided for guiding the trailing part of said sheet into second collecting part when a sheet having a length greater than the length of the first collecting part is fed to the tray.

As a result, sheets of different lengths can be easily collected in the collecting tray so that the leading edge of the variously lengthed sheets resting on one another in the first part are positioned in abutment. To remove deposited sheets only that part of the sheet collecting tray where the leading edges of deposited sheets arrive needs to be directly accessible. Preferably, the first collecting part and the second collecting part together form a collecting tray in which sheets having a length greater than the first collecting part can be stacked in the form of an inverted "U". Consequently, the sheet processing apparatus can be made compact.

Other characteristics and advantages of the invention will become apparent from a perusal of the following description of the presently preferred embodiments of a sheet processing apparatus used in a copying machine taken in connection with the accompanying drawings.

PRESENTLY PREFERRED EMBODIMENTS

Figure 1:
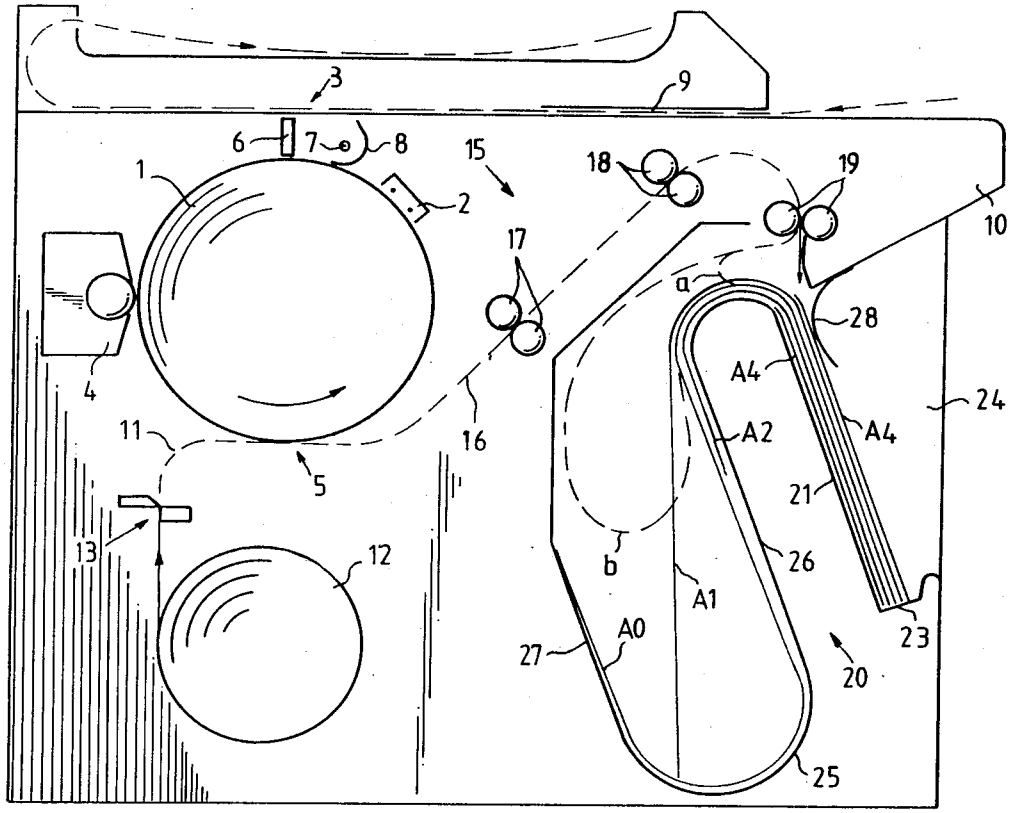
FIG. 1 represents a cross-sectional elevation of a first embodiment of the present invention.
Figure 2:
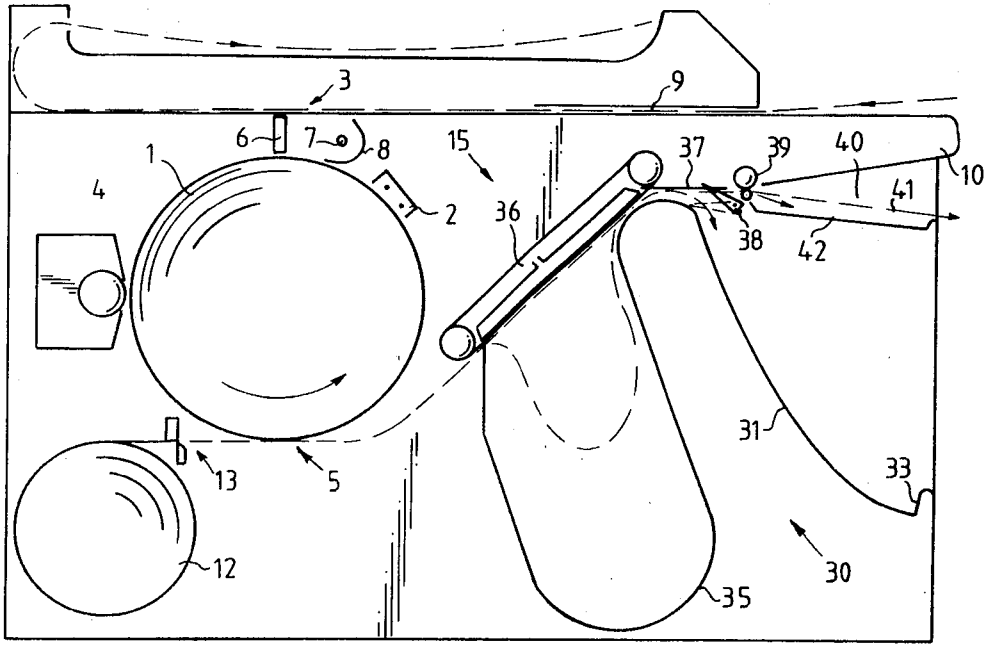
FIG. 2 represents a diagrammatic cross-sectional elevation of a second embodiment of the present invention.

Referring to FIGS. 1 and 2, the collecting tray of the present invention is described with reference to a photocopy device which is capable of delivering variously sized copies to the tray of the invention. For purposes of explanation, the photocopiers shown in the figures comprise a photo-conductive drum 1 which is rotatable in the direction of the arrow. Disposed along the periphery of drum 1 is charging device 2, an imaging device 3, a developing device 4 and an image transfer device 5. Imaging device 3 consists of an optical array 6, e.g., a SELFOC fiber array, and lamp 7 provided with reflector 8. On the side of optical array and remote from photo-conductive drum 1 is conveyor path 9 for the original to be copied. The original is fed through conveyor path 9 from the machine operating side 10 in the direction indicated by the arrow, illuminated by lamp 7, imaged by the optical array as a stripwise upright image on rotating photo-conductive drum 1 and then charged by charging device 2. Upon continuous rotation of the photo-conductive drum 1, the resulting charge image is developed by developing device 4. The developed image is then transferred directly in the image transfer device 5 to a sheet of copy material 11 and the image is fixed thereon.

The sheet to receive the copy is fed from a supply reel of copy material 12 in web form and is cut to length by cutter 13. Means are provided (but not shown) which enables the sheet to be cut to the same length as the original fed by conveyor path 9. The cut size may vary between a minimum size and a maximum size so that only sheets between these sizes can be fed through the machine without obstruction and collected in a sheet collector 15 of the present invention. Sheet collector 15 is situated beneath the original conveyor path 9 and is accessible from the copy machine operating side 10 for the removal of collected copy sheets.

Three embodiments of sheet collector 15 are described in more detail hereinafter.

Sheet collector 15 shown in FIG. 1 comprises a path 16 along which finished copy sheets are fed by conveyor roller pairs 17, 18 and 19. The last pair or rollers 19 forms a conveying nip which feeds a sheet vertically downwards into collecting tray 20 located beneath the rollers pair 19. Collecting tray 20 comprises a baseplate 21 preferably positioned at an angle of about 20° from the vertical. Baseplate 21 has an abutment ledge 23 along its bottom edge constituting a registration end. Ledge 23 adjoins the wall of the copying machine on the machine operating side 10. An opening 24 for the removal of sheets on the baseplate 21 is formed in this wall. Openings are formed in abutment ledge 23 and the bottom part of the baseplate 21 to facilitate engagement and removal of sheets on the baseplate 21.

A portion of the baseplate 21 situated a short distance beneath the top edge of the plate is positioned directly below the conveying nip formed by roller pair 19. The length of baseplate 21 measured between the bottom and top edges corresponds to the minimum length of sheet 11 that can be collected in the collector 15.

A downwardly bent leaf spring 28 presses lightly on baseplate 21 near the top edge of the plate. The top edge of the baseplate 21 is adjoined by a substantially "U"-shaped plate 25 which consists of a plate part 26 bent down in the form of an "S", its center being substantially parallel to baseplate 21, and an upwardly bent plate part 27 which is substantially parallel to baseplate 21. The distance between the top edge of the sloping part of plate part 27 and the abutment 23 as measured along the tray surface corresponds to the maximum length of a sheet that can be collected in collector 15.

The sheet collector 15 represented in FIG. 1 is suitable for collecting sheets discharged consecutively whose length can vary randomly between minimum and maximum size sheets 11.

The operation of the above-described sheet collector 15 can be better understood by reference to the following example in which the minimum size of a sheet corresponds to the length of an A4 sheet (297 mm) and the maximum size corresponds to the length of an A0 sheet (1200 mm). By way of example, FIG. 1 represents the situation in whih an A4 sheet, an A2 sheet, and A0 sheet, an A1 sheet and again an A4 sheet are collected successively in the collecting tray 20. The first A4 sheet is fed from roller pair 19, so that the leading edge meets baseplate 21 a short distance from the top edge. The sheet then slides down along baseplate 21 until the leading edge comes against abutment ledge 23. The trailing edge of the sheet is now level with the top edge of baseplate 21. Leaf spring 28 keeps the top part of the sheet more particularly pressed against the baseplate.

The next sheet (A2) is pushed with its leading edge against the abutment ledge 23 in the same way. Because this sheet is longer than baseplate 21 the trailing part of it is between the rollers 19 when the leading edge abuts ledge 23. As conveyance continues, the A2 sheet deflects outwards into the free space between rollers 19 and the top edge of collecting tray 20 (as indicated by broken line a in FIG. 1). After the trailing edge of the sheet has cleared rollers 19 the trailing portion of the sheet will hang down over the top part of "S"-shaped plate part 26 as indicated in the case of the A2 sheet in FIG. 1.

The next sheet (A0) is again pushed against the abutment ledge 23 in the same way as described above. As conveyance continues, this sheet will be deflected out further before being released by rollers 19; this intermediate position is indicated by line b. The released A0 sheet will then stop in the position indicated. The trailing part in these conditions rests against the sloping portion of plate part 27 thus avoiding the curling of the trailing part which otherwise could block the path of a subsequent sheet.

The next sheet (A1) is deposited in substantially the same way as the A0 sheet; the only difference is that the trailing portion of the sheet will now hang straight down in the "U"-shaped collecting part 25. The last sheet, an A4 sheet, is deposited on the previously collected sheets on baseplate 21.

All of the collected sheets can be removed as a unit from collecting tray 20 by engaging the sheets at the abutment ledge 23 and pulling them out of the copying machine through opening 24.

The sheet collector 15 represented in FIG. 2 has a collecting tray 30 which in principle has the same construction as the tray 20 represented in FIG. 1. The difference is that the baseplate 31 is longer than the baseplate 21 and "U"-shaped plate 35 is shorter than the "U"-shaped plate 25. As a result of this shape, it is also possible to collect long sheets having a very smooth surface without their sliding completely in the "U"-shaped collecting part. Baseplate 31 is also of hollow construction. As a result, the part of a stack of collected sheets which will be engaged to remove the stack is slightly bent so that the sheets can be directly rolled up upon removal.

The sheet collector represented in FIG. 2 also has a conveyor section consisting of a suction belt conveyor 36 which forms a bridge over "U"-shaped collecting part 35 and which can convey a copy sheet, sucked tightly against the bottom of the belt 36, over "U"-shaped collecting part 35. A deflector plate 37 is disposed a short distance above the transition of the baseplate 31 and "U"-shaped plate 35 and cooperates with the suction belt 36 to deflect and guide on a sheet supplied by suction belt 36. A sheet deflector 38 is also provided at plate 37 and is movable between two positions, a solid-line position for deflecting a sheet fed along plate 37 in the direction of baseplate 31, and a broken-line position for directly discharging a sheet out of the copying machine along path 40 by means of discharge rollers 39, such sheet, for example, being one that is longer than the maximum sheet size that can be collected in collecting tray 30 or a long sheet which is to rigid to be collected in collecting tray 30.

A rectangular depression 42 is provided in guide plate 41 forming path 40. Depression 42 is narrower than the width of the guide plate 41 to collect short sheets fitting in the vein.

The operation of the collector represented in FIG. 2 is described hereinbelow only insofar as it differs from the collector represented in FIG. 1.

When a sheet is to be deposited in collecting tray 30, deflector 38 is set to the position indicated by the solid-line. A finished copy is fed over "U"-shaped collecting part 35 by suction belt 36 and its direction is changed successively by plate 37 and deflector 38 such that it is fed over baseplate 31 as far as the abutment ledge 33. The time at which that takes place can be derived from the time at which the leading edge of said sheet is discharged from cutting position at 13. Because of the fixed distance between the cutting position and the abutment ledge, there is a fixed period between both times at a given conveying speed. At the end of that period of time the machine control system delivers a signal in response to which the suction effect of the conveyor 36 is interrupted, whereupon the trailing part of the sheet that has not yet passed the suction belt is released and arrives in the "U"-shaped collecting part.

Instead of using a suction belt at a bridge it is also possible to use a guide plate which is swung away when the leading edge of the sheet arrives at the abutment ledge. Due to the different shape of the collecting tray 30 and by the use of a bridging conveyor 36 it is possible to obtain an even more compact, lower construction of a sheet collector than collectors described in connection with FIG. 1.

Figure 3:
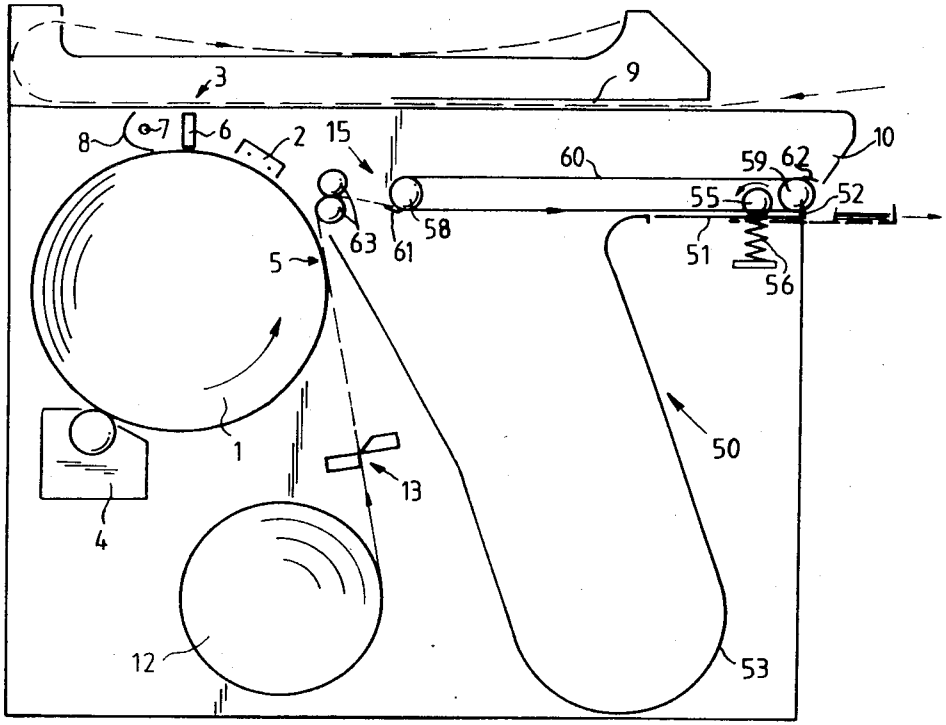
FIG. 3 represents a diagrammatic cross-sectional elevation of a third embodiment of the present invention.

The sheet collector 15 shown in FIG. 3 is provided with collecting tray 50 having horizontal baseplate 51. An abutment ledge 52 extends along the edge of baseplate 51 facing the operating side 10 of the copying part. A plate 53 is bent down in the form of a "U" to adjoin the edge of baseplate 51 which is situated opposite the abutment ledge 52. Baseplate 51 and collecting part formed by the "U"-shaped plate 53 together form collecting tray 50.

A biasing roller 55 is disposed in a fixed position above baseplate 51. Roller 55 is freely rotatable in the direction of the arrow and has a unidirectional coupling which prevents the roller from rotating in the opposite direction. Spring 56 presses baseplate 51 against the biasing roller 55. Baseplate 51 can be pressed down in opposition to the action of spring 45 by means of sheets fed over the baseplate beneath roller 55. A conveyor belt 60 trained about rollers 58 and 59 is disposed a short distance above collecting tray 50 and extends over "U"-shaped collecting part formed by plate 53 and over baseplate 51 as far as the abutment ledge 52. Conveyor belt 60 has a clamp 61 and a clamp 62 each of which can receive the leading edge of a copy sheet discharged by the pair of conveyor rollers 63 from the copying section of the photocopier. Clamps 61 and 62, respectively, are open automatically when that part of the belt on which the associated clamp is fixed runs about roller 58 or roller 59, e.g., by means of a cam disposed on rollers 58 and 59, and, are closed when that part of the belt passes through the rest of its flight. Baseplate 51 with the abutment ledge 52 is disposed in a slide (not shown) along which baseplate 51 can be pulled out of the copying machine into a position shown in broken lines.

The sheet collector represented in FIG. 3 operates as follows: In a starting position of the endless conveyor belt 60 represented in FIG. 3, clamp 61 occupies a position in which rollers 63 feed a copy sheet into the open clamp 61. If belt 60 then starts to move the clamp 61 closes and the sheet is fed over the "U"-shaped collecting part and then over baseplate 51 and beneath biasing roller 55 as far as abutment ledge 52. On further movement of belt 60, clamp 61 runs over roller 59 and, in so doing, releases the sheet held on baseplate 51 by biasing roller 55. The trailing part of the sheet is now fed into the "U"-shaped collecting part as conveyor rollers 63 continue to be driven.

On the conveyance of the sheet about the bottom relatively thin conveyor roller 63 the tendency of the rolled-up sheet material to curl is eliminated, thus preventing the trailing part of the sheet from curling inwards in the second collecting part and thus blocking the path of the next sheet.

Subsequent sheets can then be deposited in the same way, these sheets being retained on baseplate 51 by biasing roller 55. This prevents these sheets from sliding off baseplate 51 and passing completely into the "U"-shaped collecting part. If a required stack of copy sheets is collected in collecting tray 50 in this way, the baseplate is pulled out of the copying machine, at which time biasing roller 55 rotates in the direction of the arrow while maintaining the contact pressure. The stack now can be manually engaged without the operator needing to bend, and can be fully withdrawn from the copying machine.

While presently preferred embodiments have been described and shown in detail, the invention may be otherwise embodied within the scope of the appended claims.

What is claimed is:

1. Apparatus for collecting sheets of different lengths comprising a sheet collecting tray having an outermost first collecting part directly accessible for sheet removal with a sheet registration end and a conveyor means for feeding said sheets into said first collecting part up to said registration end, said collecting tray including a second innermost collecting part which adjoins the first collecting part at the level of said conveyor means and guide means guiding the trailing part of a sheet having a length greater than the first collecting part into said second collecting part.

2. Apparatus according to claim 1, wherein said first collecting part and the said second collecting part together form said collecting tray in which sheets having a length greater than the first collecting part can be stacked in the form of an inverted "U".

3. Apparatus according to claim 2, wherein said second collecting part comprises a first portion for collecting the trailing part of sheets having a length greater than the length of the first collecting part but not greater than the combined length of the first portion and the first collecting part, and a second portion for collecting the trailing part of sheets of a length greater than the first portion and the first collecting part.

4. Apparatus according to claim 3, wherein said first collecting part and said second collecting part portions together form said collecting tray in which the sheets having the greater length are stacked in the form of a "S".

5. Apparatus according to claims 2, 3 or 4, wherein said conveyor means comprises a conveyor belt provided with at least one clamp which can be set into an active state in which the clamp can retain the leading edge of a sheet fed in the sheet collecting tray in order to guide said sheet over the second collecting part to the first collecting part.

6. Apparatus according to claims 1, 2, 3 or 4, wherein said conveyor means is spaced directly above the transition between the first collecting part and the second collecting part to form a space which is in open communication with the second collecting part in order to guide into the second collecting part the trailing part of a sheet having a length greater than the first collecting part.

7. Apparatus according to any one of claims 2, 3 and 4, wherein said conveyor means can be set into two states, a first active state in which a sheet can be fed over the second collecting part to the first collecting part and a second inactive state in which the conveyor means frees the top of the second collecting part to receive the trailing part of that sheet in the second collecting part.

8. Apparatus according to claim 7, wherein said conveyor system consists of a suction belt conveyor which in the active state can retain by suction a sheet fed into the sheet collecting tray.

* * * * *